US006972138B2

(12) United States Patent
Heinrich et al.

(10) Patent No.: US 6,972,138 B2
(45) Date of Patent: Dec. 6, 2005

(54) PROCESS AND DEVICE FOR HIGH-SPEED FLAME SPRAYING

(75) Inventors: Peter Heinrich, Germering (DE); Heinrich Kreye, Hamburg (DE); Thorsten Stoltenhoff, Wentorf (DE)

(73) Assignee: Linde AG, Wiesbaden (DE)

( * ) Notice: Subject to any disclaimer, the term of this patent is extended or adjusted under 35 U.S.C. 154(b) by 0 days.

(21) Appl. No.: 10/442,185

(22) Filed: May 21, 2003

(65) Prior Publication Data

US 2004/0018317 A1 Jan. 29, 2004

(30) Foreign Application Priority Data

May 22, 2002 (DE) ..... 102 22 660

(51) Int. Cl.[7] ..... C23C 4/12; B05C 5/04
(52) U.S. Cl. ..... 427/446; 239/79; 239/85
(58) Field of Search ..... 427/446; 239/79, 239/85

(56) References Cited

U.S. PATENT DOCUMENTS 3,352,492 A * 11/1967 Cape ..... 239/85
4,836,447 A * 6/1989 Browning ..... 239/6
5,520,334 A * 5/1996 White ..... 239/85

FOREIGN PATENT DOCUMENTS

| | | |
|---|---|---|
| DE | 101 26 100 A1 * | 12/2002 |
| FR | 2 802 844 A1 | 6/2001 |
| GB | 548 630 | 10/1942 |

OTHER PUBLICATIONS

Search Report of EP App. No. 03 01 1231 completed Oct. 15, 2003.

* cited by examiner

*Primary Examiner*—Katherine Bareford

(74) *Attorney, Agent, or Firm*—Millen, White, Zelano & Branigan, P.C.

(57) ABSTRACT

The invention relates to a process and a device for high-velocity flame spraying, the spray particles being accelerated in a flame jet of combustion gases. The injection of spray particles according to the invention takes place axially and centrally in the divergent section of the Laval nozzle, the powder tube (2) and the outer nozzle body (1) together forming a Laval nozzle for acceleration of the flame jet.

17 Claims, 2 Drawing Sheets

PROCESS AND DEVICE FOR HIGH-SPEED FLAME SPRAYING

The invention relates to a process and device for producing a coating or a molding by means of high-velocity flame spraying, in which the powdered spray particles are injected into a flame jet of combustion gases by means of a powder tube and the spray particles are brought to a velocity of up to 800 m/sec when the flame jet is released in a Laval nozzle.

It is known that coatings can be applied to materials of the most varied type by thermal spraying. Known processes for this purpose are, for example, flame spraying, arc spraying, plasma spraying or high-velocity flame spraying. High-velocity flame spraying in the last two decades has become increasingly important. The special advantage of high-velocity flame spraying is that the coating material is less strongly heated and is accelerated onto the parts to be coated with much higher velocity than in flame spraying, arc spraying, or plasma spraying. For many laminated materials and applications, this entails advantages with respect to the properties of the layers.

In high-velocity flame spraying, a flame jet with a velocity exceeding 2000 m/s is produced by combustion under high pressure and the powder is injected into this jet. To produce the flame jet, a combustible gas or kerosene and oxygen are routed into the high-pressure combustion chamber of the spray gun. The combustible gases are propane, propylene, hydrogen, ethylene and acetylene. In the high-pressure combustion chamber, combustion takes place at a pressure from 0.3 to 0.5 MPa or 0.5 to 1.5 MPa. Spray guns that work in the lower of the indicated pressure ranges are assigned to the first and second generation, while spray guns in the high pressure range are assigned to the third generation. The flame jet reaches its high velocity by expansion. In the first and second generation, expansion takes place at the output of the spray gun. The spray particles e.g. WC—Co particles having sizes ranging from 10 to 45 $\mu$m here reach velocities in the range from roughly 400 to 500 m/s. In spray guns of the third generation, the expansion nozzle is located directly behind the high-pressure combustion chamber. Particle velocities in the range from 500 to 800 m/s are reached. A Laval nozzle is used for expansion of the combustion gases.

Laval nozzles consist of a convergent section and a downstream divergent section that adjoins it in the direction of flow. The contour of the nozzle must be shaped in a specific manner in the divergent area to minimize flow detachment and compression shocks, and so that the flow obeys Laval's equations laws as discussed for example in the text Gas Dynamics, Vol. 1, Zucrow and Hottman, John Wiley & Sons Inc., N.Y., pages 160–175.

Laval nozzles are thus characterized by this contour and the length of the divergent section and furthermore by the ratio of the exit cross-section to the narrowest cross-section. The narrowest cross-section of the Laval nozzle is called the nozzle throat.

Injection of the spray particles into the flame jet is accomplished by a variety of methods. In the spray guns of the first and second generation, the powder is injected axially and centrally into the high-pressure combustion chamber. In the spray guns of the third generation, the injection takes place either likewise axially and centrally or else the powder is injected behind the nozzle throat, radially into the already expanding flame jet. If the powder is injected in the high-pressure combustion chamber, the spray particles reach much higher temperatures than in injection behind the nozzle throat. The spray guns with powder feed into the combustion chamber are consequently only suited for heat-resistant materials, for example ceramics, while spray guns with radial spray particle feed at the gun outlet can also be used for spraying materials with a low melting point, such as for example aluminum and copper alloys. Radial injection of the spray particles, however, causes nonuniform acceleration of spray particles of the same size and thus different final velocities of these spray particles. Different velocities of the spray particles when hitting the workpiece, however, lead to irregularities and faults in the coating. Furthermore, in radial injection of the spray particles, the nozzle wall erodes at the location that is on the opposite side of the spray particle inlet. This increases the wear of the expansion nozzle that is heavily loaded anyway and consequently adversely affects the economic efficiency of the process.

Therefore, objects of this invention are to provide a process and a device for high-velocity flame spraying that injects the spray particles outside of the hot combustion chamber while avoiding the above-mentioned disadvantages of nonuniform acceleration and nozzle wall erosion.

Upon further study of the specification to appended claims, other objects and advantages will become apparent.

These objects are achieved according to the invention in that injection of the spray particles takes place axially and centrally in the divergent section of the Laval nozzle. The axial and central injection of spray particles ensures uniform acceleration of the spray particles. Since the spray particles are injected in the center of the flame jet, all particles undergo almost the same acceleration forces and consequently reach almost the same final velocity. Consequently, the coatings and moldings produced with the process according to the invention are of extremely high quality. In addition, axial and central spray particle injection prevents erosion of the inner nozzle wall, since the spray particles are injected in the direction of the flame jet and are guided by it straight ahead in the spray direction. Furthermore, this injection minimizes swirling and turbulence, and thus yields optimum acceleration of the spray particles. Other advantages accrue as a result of the injection site: By injection in the divergent section of the Laval nozzle, overheating and excessive melting of the spray particles are prevented. The powder does not travel into the combustion chamber and is added to the flame jet of combustion gases only when its temperature has decreased as a result of expansion in the nozzle. Injection in the divergent section of the Laval nozzle thus allows use of heat sensitive particles. Also with heat-resistant powders, it is possible to avoid excessive melting of the particles that adversely affects the quality of the coating.

In an advantageous variant of the invention, the passage for the flame jet has a circular ring-shaped cross-section at the narrowest point. The latter is bordered to the inside by the outside contour of the powder tube and to the outside by the inside contour of the nozzle tube. In this passage, the flame jet is accelerated. The consumption of combustion gases and thus fuel and oxygen is furthermore dictated by the size of the passage. Since the circular ring-shaped cross-section can be relatively small, the process economics are favorable.

The high-velocity flame spraying device according to the invention is characterized in that the powder tube ends axially and centrally in the divergent section inside the outside nozzle body. The arrangement of the powder tube according to the invention minimizes erosion of the outside nozzle body, since the direction of flow of the flame jet is considered in the arrangement of the flame jet and the spray particles when injected have minimal, if any velocity components in the direction of the outer nozzle wall. The high-velocity flame spraying device furthermore dictates the conditions for optimum acceleration of the spray particles by the central arrangement of the powder tube. Disruptive swirling and turbulence are largely stopped by the arrangement according to the invention. Because the powder tube ends only in the divergent section of the outer nozzle body, it becomes possible with the high-velocity flame spraying device to use easily melted spray particles that cannot withstand the high heat in the combustion chamber. It is also advantageous for the heat-resistant spray particles so that they are not overheated or do not begin to melt excessively.

In an advantageous embodiment of the invention, the injection of the powdered particles takes place at a site that is located in the area between one-fourth and one-half of a segment with its starting point that is fixed by the nozzle throat and its end point by the nozzle exit, measurements being taken from the nozzle throat.

Alternatively, a Laval nozzle is formed from a powder tube located inside with a smooth cylindrical outer side and an outer nozzle body that is shaped accordingly on its inside.

The Laval nozzle is formed in another possibility in that the necessary contour for the Laval nozzle is applied partially to the outside of the powder tube and partially to the inside of the outer nozzle body.

The expansion ratio of the Laval nozzle, i.e., the ratio of the cross-sectional area for gas passage at the narrowest point to the cross-section at the outlet of the nozzle in one advantageous embodiment is between 1:2 and 1:25, preferably between 1:5 and 1:11.

In a preferred variant, the outer nozzle body in the convergent region has a circular ring-shaped cross-section that in the divergent area of the nozzle passes into a rectangular cross-section. Narrow areas and large surfaces are advantageously coated using rectangular shapes.

Advantageously, both the powder tube and also the outer nozzle body each is comprised of a metallic material, a ceramic, or a composite material with metallic or ceramic components. The powder tube and the nozzle body in one advantageous embodiment are comprised of different materials. They include various metal alloys, various ceramics, plastics or a combination of different materials, e.g., metal/ceramic, metal/plastic, and ceramic/plastic. Preferably the outer nozzle body is made of metal, while the inner powder tube is made of ceramic.

The powder tube and/or the outer nozzle body in one advantageous variant comprises—viewed in the direction of flow—two or more parts, in which the first part encompasses the area around the nozzle throat and the second part that extends to the nozzle outlet adjoins it. Here, the second part can be easily replaced and with respect to its shape and material selection is chosen according to the requirements of the various spray materials. In this case, the two parts just mentioned are comprised advantageously of different materials.

BRIEF DESCRIPTION OF DRAWINGS

The prior art and the invention are detailed below using schematic examples.

DETAILED DESCRIPTION OF DRAWINGS

Figure 1:
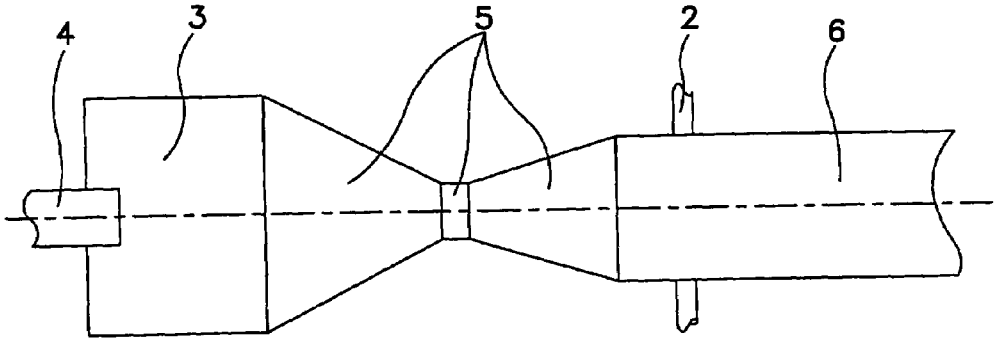
FIG. 1 PRIOR ART
FIG. 1 shows a high-velocity flame spraying device according to the prior art.

FIG. 1 shows the principle of the expansion nozzle. This principle is used, for example, in the JP-5000 system that belongs to the third generation of high-velocity flame spraying devices, described for example in TAFA Technical Data bulletin File 1.3.2.5.4 K10801, copyright 1993, TAFA Incorporated Concord, N.H., USA. The feed pipe 4 adjoins the high-pressure combustion chamber 3 followed by the Laval nozzle 5 with the nozzle constriction and the end piece 6 into which the powder tubes 2 lead. Kerosene and oxygen travel through the feed pipe 4 into the high-pressure combustion chamber 3 where the two substances react with one another. The combustion gases form a flame jet that is accelerated by expansion in the Laval nozzle 5 to supersonic velocity. In the end piece 6 following the Laval nozzle 5, the powder is injected with two powder tubes 2 radially into the flame jet.

Figure 2:
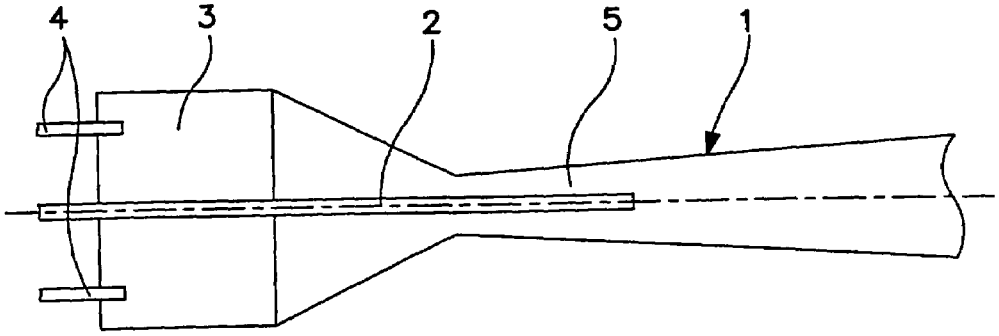
FIG. 2 shows a high-velocity flame spraying device according to the invention, wherein the powder tube ends in the divergent area of the outer nozzle body.

The high-velocity flame spraying device that is shown schematically in FIG. 2 comprises a Laval nozzle 5 with an outer nozzle body 1, a powder tube 2, a high-pressure combustion chamber 3 and two feed pipes 4. Fuel gas and oxygen travel through the feed pipes 4 into the high-pressure combustion chamber 3, where the chemical reaction takes place. Instead of the fuel gas, kerosene can be used. The combustion gases expand in the Laval nozzle 5 that adjoins the high-pressure combustion chamber. The powder tube 2 ends first in the divergent section of the Laval nozzle 5. The outer surface of the powder tube 2 and the inner surface of the outer nozzle body 1 are configured according to the invention such that the expansion nozzle 5 obeys Laval's laws.

Figure 3A:
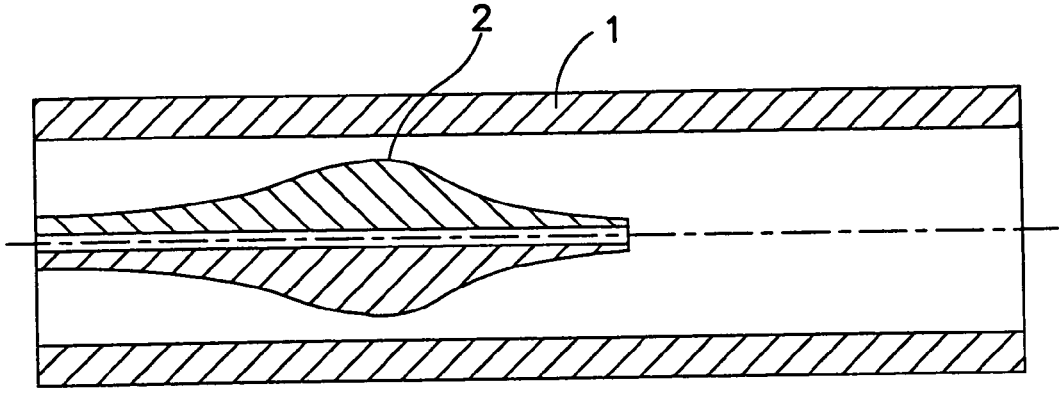
FIGS. 3*a*), 3*b*), and 3*c*) shows show three variants for the configuration of the Laval nozzle comprising the powder tube and the outer nozzle body.
Figure 3B:
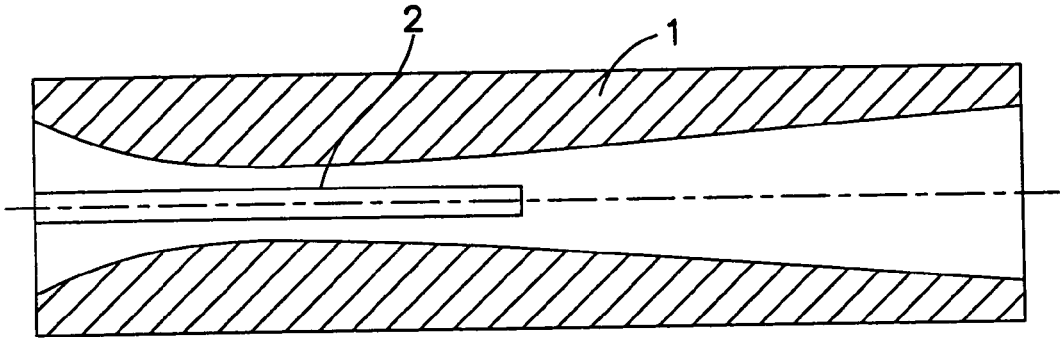
FIG. 3 shows three variants for the configuration of the Laval nozzle comprising the powder tube and the outer nozzle body.
Figure 3C:
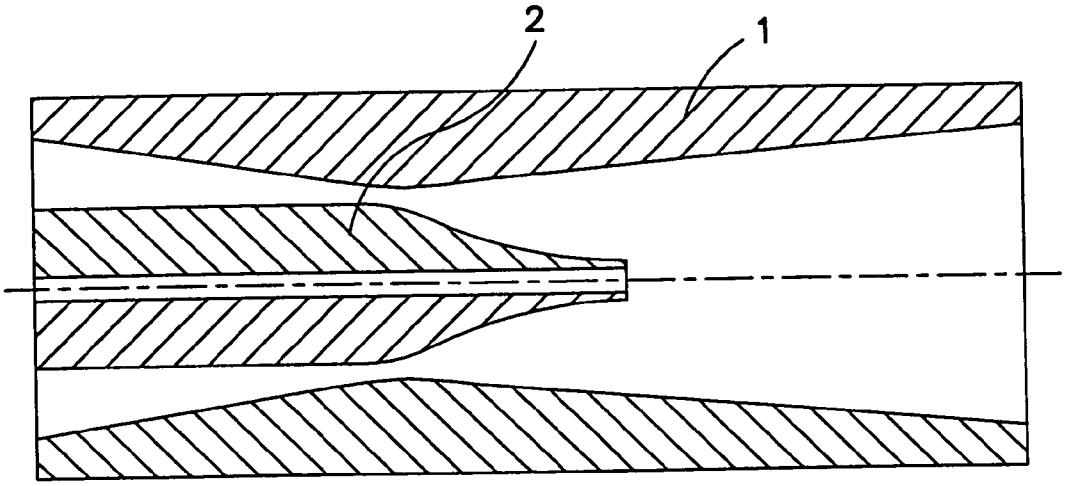

FIG. 3 shows three especially advantageous embodiments of a high-velocity flame spraying device according to the invention with an outer nozzle body 1 and powder tube 2, reference being made especially to the configuration of the powder tube 2 and the outer nozzle body 1. In FIGS. 3*a, b*, and *c*, the powder tube 2 in each case is surrounded by the outer nozzle body 1. The combination of the inner contour of the outer nozzle body and the outer shape of the powder tube yield a Laval nozzle. In FIG. 3*a*, a smooth, cylindrical inside shape of the outer nozzle body together with the outside contour of the powder tube arched to the outside yields a Laval nozzle. In FIG. 3*b*, conversely, the powder tube is shaped cylindrically and the outer nozzle body in its inside is curved. The nozzle body and powder tube are curved in FIG. 3*c* such that the contour necessary for the Laval nozzle results from the combination of the shapes of the outside of the powder tube and the inside of the outer nozzle body.

Also, the process of the invention is intended to yield particle velocities of, for example, about 500–800 m/sec.

The preceding examples can be repeated with similar success by substituting the generically or specifically described reactants and/or operating conditions of this invention for those used in the preceding examples.

The entire disclosure of all applications, patents and publications, cited herein and of corresponding German application No. 10222660.1, filed May 22, 2002, is incorporated by reference herein.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. In a process comprising flame spraying particulate material in a spray direction through a nozzle exit, wherein powdered particles are injected into a flame jet of combustion gases, and the particles are brought to speeds of up to about 800 m/s when the combustion gases are passed through a Laval nozzle, said Laval nozzle comprising an outer nozzle body, a nozzle throat, a nozzle exit, a convergent zone and a divergent zone, the improvement comprising injecting the powdered particles axially and centrally in the divergent zone of the Laval nozzle.

2. A process according to claim 1, wherein the powdered particles are injected by a powder tube oriented in the spray direction and located in the outer nozzle body, the powder tube having an outer contour in combination with an inner contour of the outer nozzle body which forms the Laval nozzle.

3. A process according to claim 1, wherein injection of the powdered particles takes place at a site located between one-fourth and one-half the length of a zone having its starting point fixed by the nozzle throat and its end point by the nozzle exit, measurements being taken length-wise from the nozzle throat.

4. A process according to claim 2, wherein the passage for the flame jet at a junction between the convergent zone and the divergent zone has a circular ring-shaped cross-section bordered to the inside by the outer contour of the powder tube and to the outside by the inner contour of the outer nozzle body.

5. A process for flame spraying particulate material in a Laval nozzle, comprising:

injecting particles into a flame jet of combustion gases axially and centrally in a divergent zone of the Laval nozzle, wherein the particles are brought up to speeds of about 800 m/s when passing the combustion gases through the Laval nozzle.

6. A high-velocity flame spraying device comprising a combustion chamber and a Laval nozzle comprising an outer nozzle body (1), within said outer body a converging section connected through a nozzle throat to a diverging section, having a nozzle exit and a powder tube (2), the powder tube providing for supply of spray particles within the outer nozzle body, wherein the powder tube ends within the outer nozzle body axially and centrally in the divergent section of the Laval nozzle, said Laval nozzle being in communication with an outlet from said combustion chamber.

7. A high-velocity flame spraying device according to claim 6, wherein an inner shape of the outer nozzle body, which together with an outer shape of the powder tube oriented in the spray direction and located coaxially in the outer nozzle body, forms the Laval nozzle.

8. A high-velocity flame spraying device according to claim 6, wherein the powder tube located inside has a contour on its outerside, which together with a smooth, cylindrical inside contour of the outer nozzle body, forms the Laval nozzle.

9. A high-velocity flame spraying device according to claim 6, wherein the powder tube located inside has a smooth cylindrical outer side and the outer nozzle body is shaped on its inside so as to form the Laval nozzle.

10. A high-velocity flame spraying device according to claim 6, wherein contours required for the Laval nozzle are partially on the outer side of the powder tube and partially on an inner side of the outer nozzle body.

11. A high-velocity flame spraying device according to claim 6, wherein the ratio of the cross-sectional area for gas passage at the connection between the converging and diverging section to the cross-section at the nozzle exit is from about 1:2–about 1:25.

12. A process according to claim 11, wherein said ratio is between 1:5 and 1:11.

13. A high-velocity flame spraying device according to claim 6, wherein the outer nozzle body in the convergent zone has a circular ring-shaped cross-section and the outer nozzle body at the throat or in the divergent zone has a rectangular cross-section.

14. A high-velocity flame spraying device according to claim 6, wherein the powder tube and also the outer nozzle body each comprises a metallic material, a ceramic, or a composite material with metallic or ceramic components.

15. A high-velocity flame spraying device according to claim 6, wherein the powder tube and the outer nozzle body are comprised of different materials.

16. A high-velocity flame spraying device according to claim 6, wherein the powder tube and/or the outer nozzle body comprises, in the direction of flow, two or more parts, in which the first part encompasses the area around a nozzle throat and the second part adjoins the first part and extends to a nozzle exit, the second part being easily interchangeable.

17. A high-velocity flame spraying device according to claim 16, wherein the two parts comprise different materials.

* * * * *